US009979074B2

(12) United States Patent
Chen et al.

(10) Patent No.: US 9,979,074 B2
(45) Date of Patent: May 22, 2018

(54) MOBILE DEVICE

(71) Applicant: Quanta Computer Inc., Taoyuan (TW)

(72) Inventors: Chun-I Chen, Taoyuan (TW); Chi-Hsuan Lee, Taoyuan (TW); Chung-Ting Hung, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days. days.

(21) Appl. No.: 15/286,893

(22) Filed: Oct. 6, 2016

(65) Prior Publication Data

US 2018/0013190 A1 Jan. 11, 2018

(30) Foreign Application Priority Data

Jul. 6, 2016 (TW) ..... 105121329 A

(51) Int. Cl.
*H01Q 1/24* (2006.01)
*H01Q 1/36* (2006.01)
*H01Q 1/48* (2006.01)

(52) U.S. Cl.
CPC ..... *H01Q 1/243* (2013.01); *H01Q 1/36* (2013.01); *H01Q 1/48* (2013.01)

(58) Field of Classification Search
CPC ..... H01Q 1/243; H01Q 1/36; H01Q 1/48
See application file for complete search history.

(56) References Cited

U.S. PATENT DOCUMENTS

2013/0002510 A1* 1/2013 Azulay ..... H01Q 1/243 343/860
2013/0257674 A1* 10/2013 Li ..... H01Q 5/321 343/853

FOREIGN PATENT DOCUMENTS

TW 201415714 A 4/2014

OTHER PUBLICATIONS

Chinese language office action dated Jan. 24, 2018, issued in application No. TW 105121329.

* cited by examiner

*Primary Examiner* — Graham Smith
(74) *Attorney, Agent, or Firm* — McClure, Qualey & Rodack, LLP

(57) ABSTRACT

A mobile device includes a ground plane, a first antenna, a second antenna, a first metal element, and a second metal element. The first antenna has a first feeding point coupled to a first signal source. The second antenna has a second feeding point coupled to a second signal source. The first metal element has a connection end and an open end. The connection end of the first metal element is coupled to the ground plane, and is adjacent to the first feeding point. The second metal element has a connection end and an open end. The connection end of the second metal element is coupled to the ground plane, and is adjacent to the second feeding point.

8 Claims, 6 Drawing Sheets

200

MOBILE DEVICE

CROSS REFERENCE TO RELATED APPLICATIONS

This Application claims priority of Taiwan Patent Application No. 105121329 filed on Jul. 6, 2016, the entirety of which is incorporated by reference herein.

BACKGROUND OF THE INVENTION

Field of the Invention

The disclosure generally relates to a mobile device, and specifically, to a mobile device for reducing an ECC (Envelope Correlation Coefficient) between antennas.

Description of the Related Art

With the progress being made in mobile communication technology, mobile devices such as portable computers, mobile phones, tablet computers, multimedia players, and other hybrid functional mobile devices have become common. To satisfy the demand of users, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

MIMO (Multi-Input and Multi-Output) technology is usually used for antenna designs in mobile devices. However, since antenna elements in mobile devices have similar radiation patterns and are disposed close to each other, it often results in a high ECC (Envelope Correlation Coefficient) between antenna elements, thereby degrading the communication quality of mobile devices. As a result, there is a need to propose a novel solution for overcoming the problems of the prior art.

BRIEF SUMMARY OF THE INVENTION

In a preferred embodiment, the disclosure is directed to a mobile device including a ground plane, a first antenna, a second antenna, a first metal element, and a second metal element. The first antenna has a first feeding point coupled to a first signal source. The second antenna has a second feeding point coupled to a second signal source. The first metal element has a connection end and an open end. The connection end of the first metal element is coupled to the ground plane, and is adjacent to the first feeding point. The second metal element has a connection end and an open end. The connection end of the second metal element is coupled to the ground plane, and is adjacent to the second feeding point.

In some embodiments, the first metal element and the second metal element are configured to change radiation patterns of the first antenna and the second antenna, thereby reducing an ECC (Envelope Correlation Coefficient) between the first antenna and the second antenna.

In some embodiments, the first antenna and the second antenna cover a same operation frequency which is about 751 MHz.

In some embodiments, the first metal element substantially has an L-shape. The length of the first metal element is approximately equal to 0.25 wavelength of the operation frequency.

In some embodiments, the second metal element substantially has an L-shape. The length of the second metal element is approximately equal to 0.25 wavelength of the operation frequency.

In some embodiments, the ground plane has a first edge and a second edge which are perpendicular to each other. The connection end of the first metal element is coupled to the first edge. The connection end of the second metal element is coupled to the second edge. The first antenna and the second antenna are both adjacent to a corner between the first edge and the second edge.

In some embodiments, the first antenna and the second antenna are monopole antennas and are disposed on a dielectric substrate.

In some embodiments, the dielectric substrate has a first surface, a second surface, and a third surface. The first surface and the third surface are parallel to each other. The second surface is perpendicular to the first surface and the third surface. Both the first antenna and the second antenna extend from the first surface through the second surface onto the third surface.

In some embodiments, the first antenna includes a first radiation element, a second radiation element, and a third radiation element. The first radiation element is coupled to the first feeding point, and has a meandering structure so as to define a first notch. The first radiation element extends from the first surface through the second surface onto the third surface, and further extends from the third surface through the second surface back onto the first surface. The second radiation element is coupled to the first radiation element, and is disposed in the first notch. The second radiation element extends from the first surface onto the second surface. The third radiation element is coupled to the first radiation element. The third radiation element extends from the first surface through the second surface onto the third surface.

In some embodiments, the second antenna includes a fourth radiation element and a fifth radiation element. The fourth radiation element is coupled to the second feeding point, and has a meandering structure so as to define a second notch. The fourth radiation element extends from the first surface through the second surface onto the third surface, and further extends from the third surface through the second surface back onto the first surface. The fifth radiation element is coupled to the fourth radiation element, and is disposed in the second notch. The fifth radiation element extends from the first surface onto the second surface.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are described in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
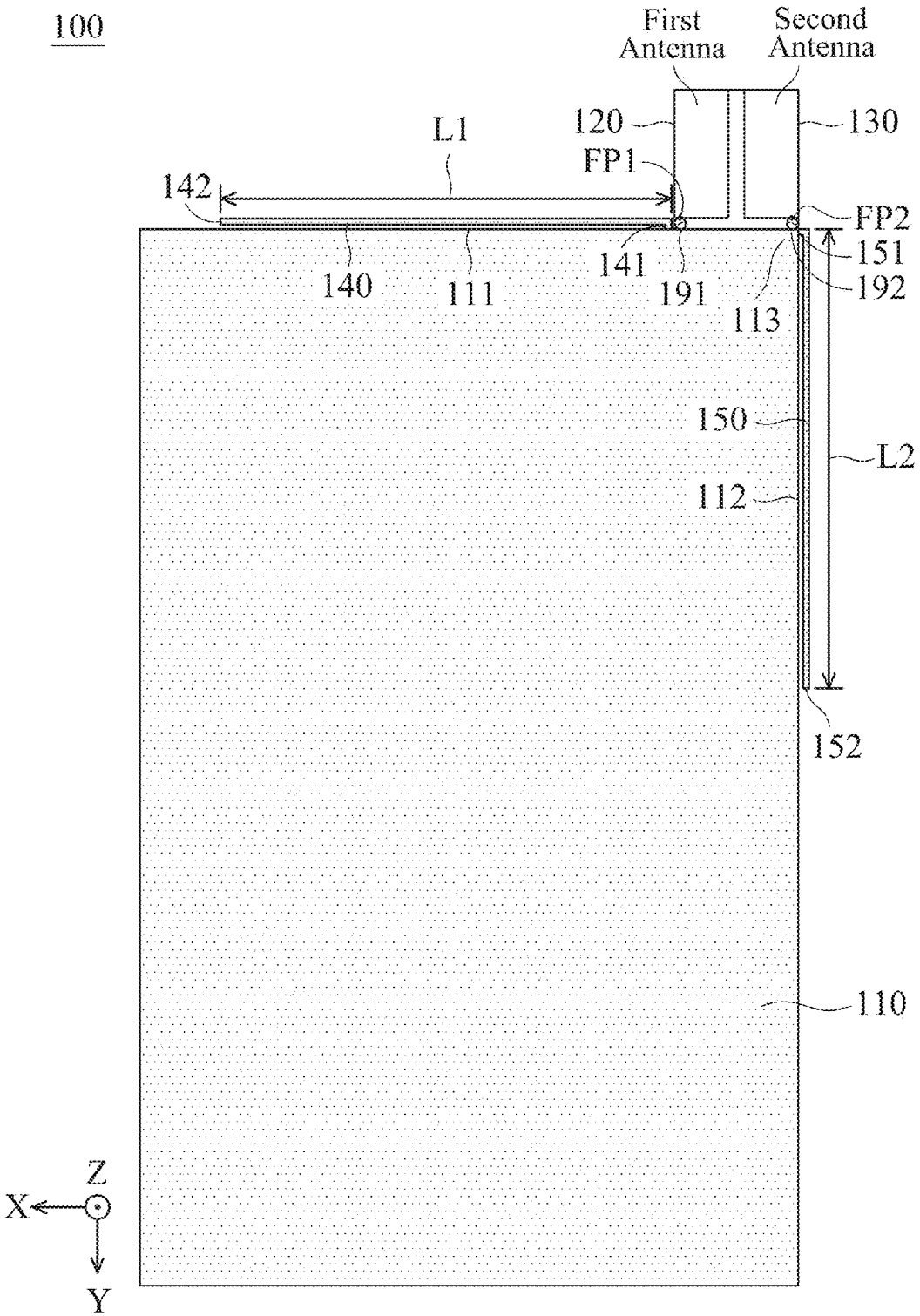
FIG. 1 is a top view of a mobile device according to an embodiment of the invention.

FIG. 1 is a top view of a mobile device 100 according to an embodiment of the invention. The mobile device 100 may be a tablet computer or a notebook computer. As shown in FIG. 1, the mobile device 100 includes a ground plane 110, a first antenna 120, a second antenna 130, a first metal element 140, and a second metal element 150. It should be noted that the mobile device 100 may further include other components, such as a processor, a display device, a touch control module, a power supply module, and a housing, although they are not displayed in FIG. 1.

The ground plane 110 may be a rectangular metal plane. The first antenna 120 has a first feeding point FP1. The first feeding point FP1 is coupled to a first signal source 191. The second antenna 130 has a second feeding point FP2. The second feeding point FP2 is coupled to a second signal source 192. The first signal source 191 and the second signal source 192 may be RF (Radio Frequency) transceivers for exciting the first antenna 120 and the second antenna 130. The type and shape of the first antenna 120 and the second antenna 130 are not limited in the invention. For example, any one of the first antenna 120 and the second antenna 130 may be a monopole antenna, a dipole antenna, a patch antenna, a loop antenna, a helical antenna, or a chip antenna.

The first metal element 140 has a connection end 141 and an open end 142. The connection end 141 of the first metal element 140 is coupled to the ground plane 110 and is adjacent to the first feeding point FP1. For example, the distance between the connection end 141 of the first metal element 140 and the first feeding point FP1 may be shorter than 2 mm. The second metal element 150 has a connection end 151 and an open end 152. The connection end 151 of the second metal element 150 is coupled to the ground plane 110 and is adjacent to the second feeding point FP2. For example, the distance between the connection end 151 of the second metal element 150 and the second feeding point FP2 may be shorter than 2 mm. The first metal element 140 and the second metal element 150 are configured to change the radiation patterns of the first antenna 120 and the second antenna 130, thereby reducing an ECC (Envelope Correlation Coefficient) between the first antenna 120 and the second antenna 130. The first metal element 140 and the second metal element 150 are respectively disposed adjacent to the first feeding point FP1 and the second feeding point FP2 because the relatively strong feeding currents at the first feeding point FP1 and the second feeding point FP2 can cause the first metal element 140 and the second metal element 150 to respectively resonate with the first antenna 120 and the second antenna 130.

Specifically, the ground plane 110 has a first edge 111 and a second edge 112 which are perpendicular to each other. The connection end 141 of the first metal element 140 is coupled to the first edge 111 of the ground plane 110. The open end 142 of the first metal element 140 extends substantially parallel to the first edge 111 of the ground plane 110. The connection end 151 of the second metal element 150 is coupled to the second edge 112 of the ground plane 110. The open end 152 of the second metal element 150 extends substantially parallel to the second edge 112 of the ground plane 110. The first antenna 120 and the second antenna 130 are both adjacent to a corner 113 between the first edge 111 and the second edge 112. The first antenna 120 and the second antenna 130 can cover the same operation frequency. For example, the aforementioned operation frequency may be about 751 MHz, i.e., the frequency band of the LTE (Long Term Evolution) Band 3. The first metal element 140 may substantially have an L-shape. The length L1 of the first metal element 140 may be approximately equal to 0.25 wavelength ($\lambda/4$) of the operation frequency. The second metal element 150 may substantially have an L-shape. The length L2 of the second metal element 150 may be approximately equal to 0.25 wavelength ($\lambda/4$) of the operation frequency. The above design of the lengths L1 and L2 causes the first metal element 140 and the second metal element 150 to resonate at the aforementioned operation frequency, thereby attracting the surface currents on the ground plane 110; accordingly, it can change the radiation patterns of nearby antennas and reduce the ECC between the antennas.

Figure 2A:
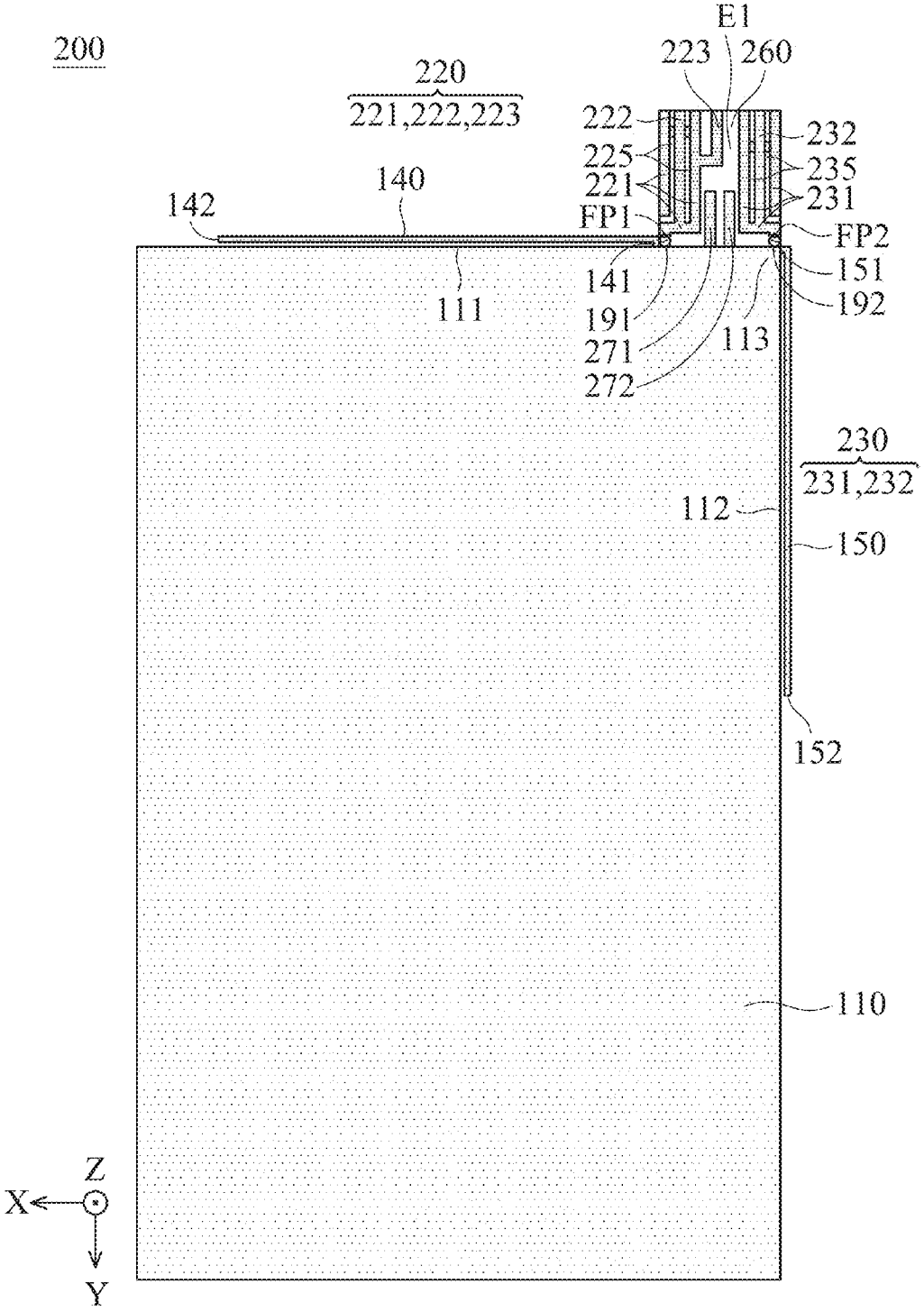
FIG. 2A is a top view of a mobile device according to an embodiment of the invention.
Figure 2B:
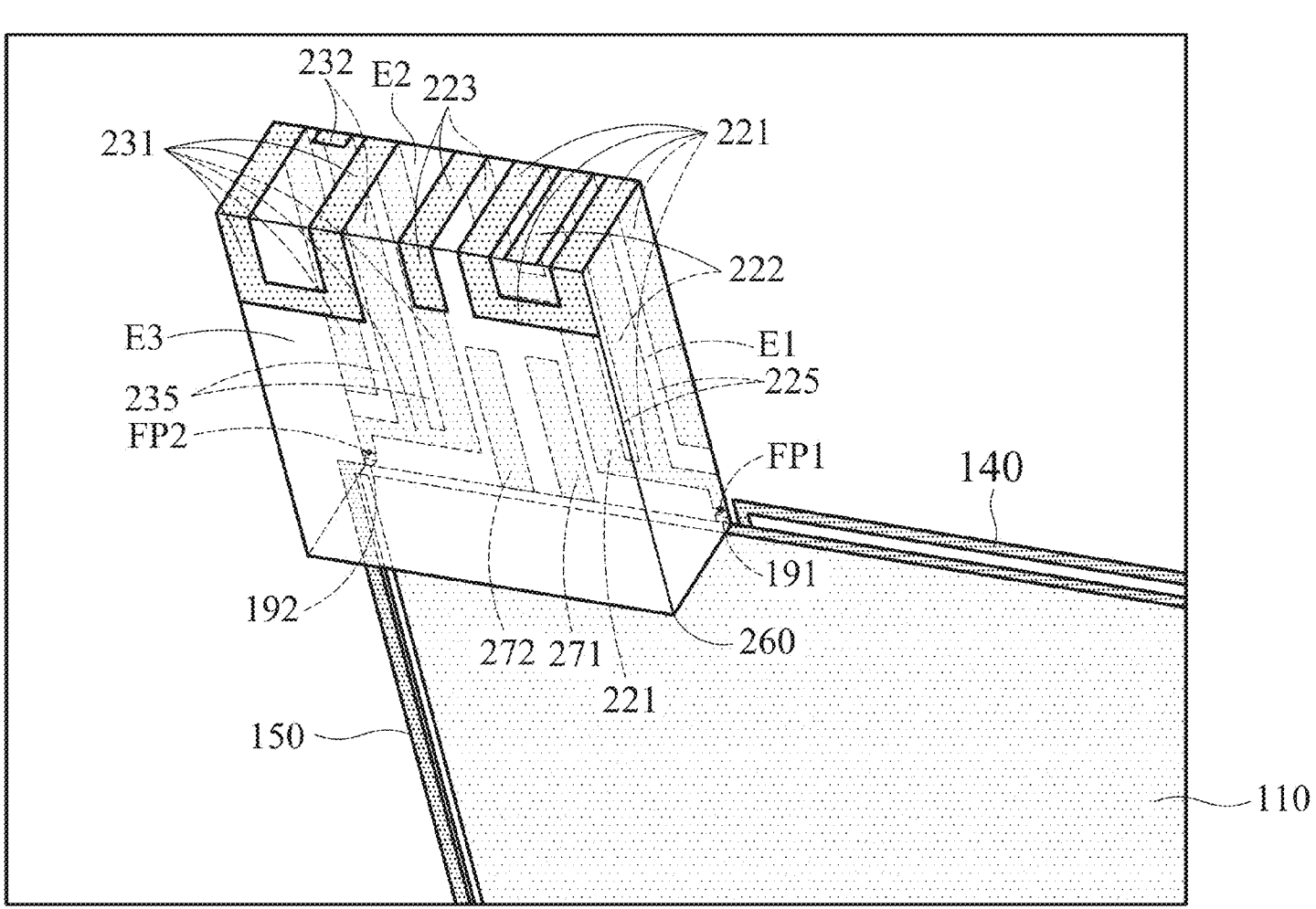
FIG. 2B is a perspective view of a mobile device according to an embodiment of the invention.

FIG. 2A is a top view of a mobile device 200 according to an embodiment of the invention. FIG. 2B is a perspective view of the mobile device 200 according to an embodiment of the invention. Please refer to FIG. 2A and FIG. 2B together. The mobile device 200 of FIG. 2A and FIG. 2B is similar to the mobile device 100 of FIG. 1A and FIG. 1B. In the embodiment of FIG. 2A and FIG. 2B, the mobile device 200 further includes a dielectric substrate 260, and a first antenna 220 and a second antenna 230 of the mobile device 200 have specific structures. It should be understood that the aforementioned specific antenna structures are merely exemplary, rather than limitations of the invention.

The first antenna 220 and the second antenna 230 are monopole antennas, and are disposed on the dielectric substrate 260. The dielectric substrate 260 may be an FR4

(Flame Retardant 4) substrate. Specifically, the dielectric substrate 260 has a first surface E1, a second surface E2, and a third surface E3. The first surface E1 and the third surface E3 are parallel to each other. The second surface E2 is perpendicular to the first surface E1 and the third surface E3. Both the first antenna 220 and the second antenna 230 are 3D (Three-Dimensional) structures, and they both extend from the first surface E1 through the second surface E2 onto the third surface E3.

More particularly, the first antenna 220 includes a first radiation element 221, a second radiation element 222, and a third radiation element 223. If the first radiation element 221 expands on a plane, it will substantially have a U-shape. The first radiation element 221 is coupled to the first feeding point FP1, and has a meandering structure so as to define a first notch 225. The first radiation element 221 extends from the first surface E1 through the second surface E2 onto the third surface E3, and further extends from the third surface E3 through the second surface E2 back onto the first surface E1. If the second radiation element 222 expands on a plane, it will substantially have a straight-line shape. The second radiation element 222 is coupled to the first radiation element 221, and is disposed in the first notch 225. The second radiation element 222 extends from the first surface E1 onto the second surface E2. If the third radiation element 223 expands on a plane, it will substantially have an L-shape. The third radiation element 223 is coupled to the first radiation element 221. The third radiation element 223 extends from the first surface E1 through the second surface E2 onto the third surface E3. The second antenna 230 includes a fourth radiation element 231 and a fifth radiation element 232. If the fourth radiation element 231 expands on a plane, it will substantially have a U-shape. The fourth radiation element 231 is coupled to the second feeding point FP2, and has a meandering structure so as to define a second notch 235. The fourth radiation element 231 extends from the first surface E1 through the second surface E2 onto the third surface E3, and further extends from the third surface E3 through the second surface E2 back onto the first surface E1. If the fifth radiation element 232 expands on a plane, it will substantially have a straight-line shape. The fifth radiation element 232 is coupled to the fourth radiation element 231, and is disposed in the second notch 235. The fifth radiation element 232 extends from the first surface E1 onto the second surface E2. The first radiation element 221 and the fourth radiation element 231 are substantially mirror-symmetrical with respect to a central line of the dielectric substrate 260. The length of the fifth radiation element 232 is slightly shorter than the length of the second radiation element 222.

In some embodiments, the first antenna 220 further includes a first parasitic element 271, which substantially has a straight-line shape. The first parasitic element 271 is disposed on the first surface E1, and is completely separate from the first radiation element 221, the second radiation element 222, and the third radiation element 223. The first parasitic element 271 has a connection end and an open end. The connection end of the first parasitic element 271 is coupled to the ground plane 110. The first parasitic element 271 is an optional element for tuning the high-frequency impedance matching of the first antenna 220. In some embodiments, the second antenna 230 further includes a second parasitic element 272, which substantially has a straight-line shape. The second parasitic element 272 is disposed on the first surface E1, and is completely separate from the fourth radiation element 231 and the fifth radiation element 232. The second parasitic element 272 has a connection end and an open end. The connection end of the second parasitic element 272 is coupled to the ground plane 110. The second parasitic element 272 is an optional element for tuning the high-frequency impedance matching of the second antenna 230.

In some embodiments, the element sizes of the mobile device 200 are as follows. The ground plane 110 has a length of about 210 mm, and a width of about 130 mm. The first metal element 140 has a length of about 89 mm. The second metal element 150 has a length of about 91 mm. The dielectric substrate 260 has a length of about 27 mm, and a width of about 24 mm.

Figure 3A:
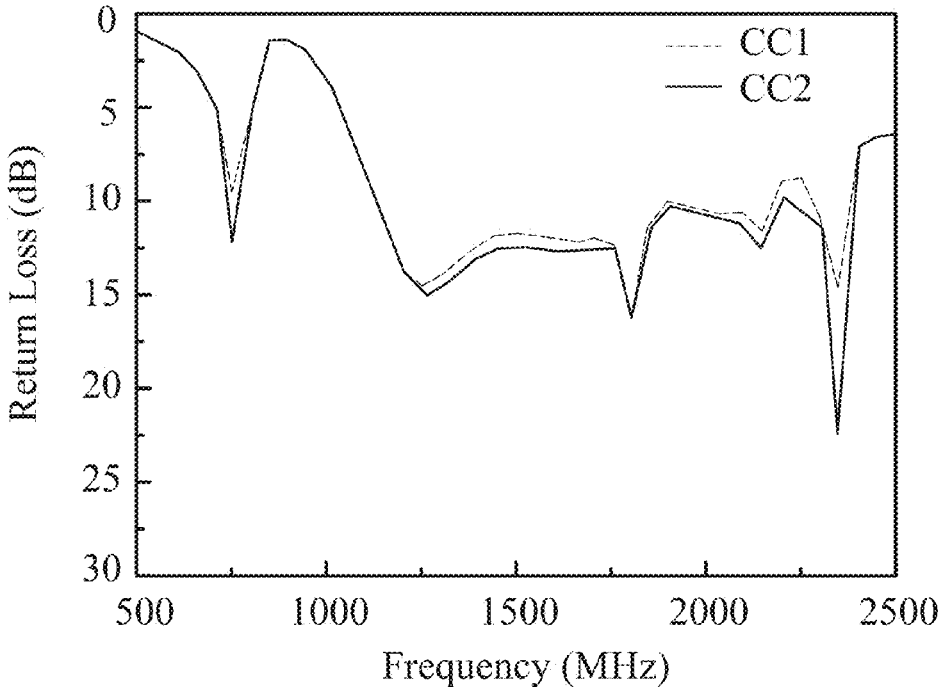
FIG. 3A is a diagram of return loss of a first antenna of a mobile device according to an embodiment of the invention.

FIG. 3A is a diagram of return loss of the first antenna 220 of the mobile device 200 according to an embodiment of the invention. The horizontal axis represents the operation frequency (MHz), and the vertical axis represents the return loss (dB). In the embodiment of FIG. 3A, a first curve CC1 represents the operation characteristics of the first antenna 220 when the mobile device 200 does not include the first metal element 140 and the second metal element 150, and a second curve CC2 represents the operation characteristics of the first antenna 220 when the mobile device 200 includes the first metal element 140 and the second metal element 150. According to the measurement of FIG. 3A, the first antenna 220 is a wideband antenna for covering the operation frequency of 751 MHz, and the incorporation of the first metal element 140 and the second metal element 150 does not affect the characteristic of the first antenna 220 so much.

Figure 3B:
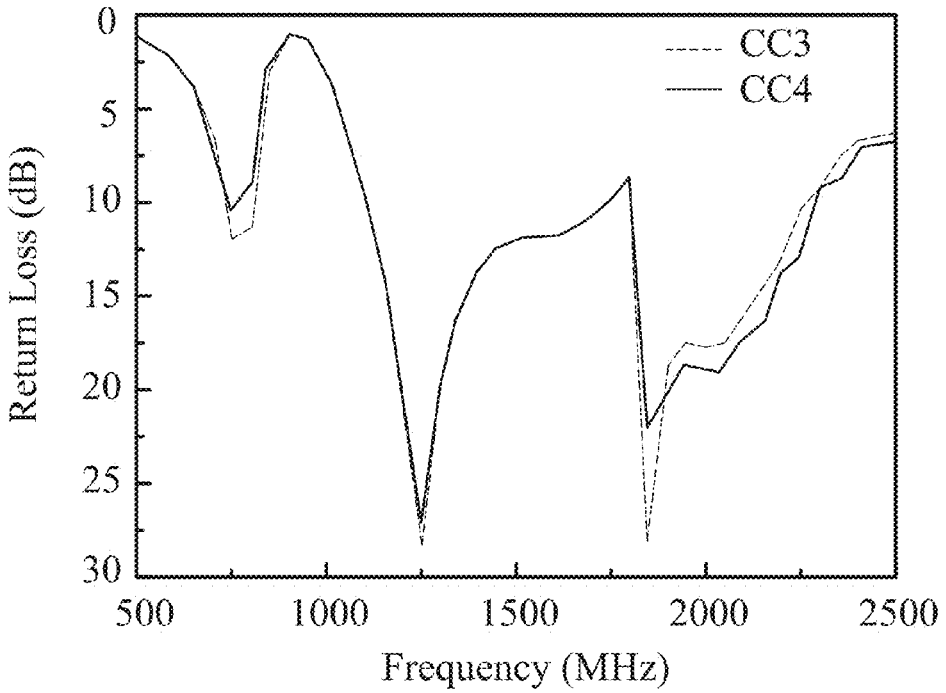
FIG. 3B is a diagram of return loss of a second antenna of a mobile device according to an embodiment of the invention.

FIG. 3B is a diagram of return loss of the second antenna 230 of the mobile device 200 according to an embodiment of the invention. The horizontal axis represents the operation frequency (MHz), and the vertical axis represents the return loss (dB). In the embodiment of FIG. 3B, a third curve CC3 represents the operation characteristics of the second antenna 230 when the mobile device 200 does not include the first metal element 140 and the second metal element 150, and a fourth curve CC4 represents the operation characteristics of the second antenna 230 when the mobile device 200 includes the first metal element 140 and the second metal element 150. According to the measurement of FIG. 3B, the second antenna 230 is a wideband antenna for covering the operation frequency of 751 MHz, and the incorporation of the first metal element 140 and the second metal element 150 does not affect the characteristic of the second antenna 230 so much.

Figure 4A:
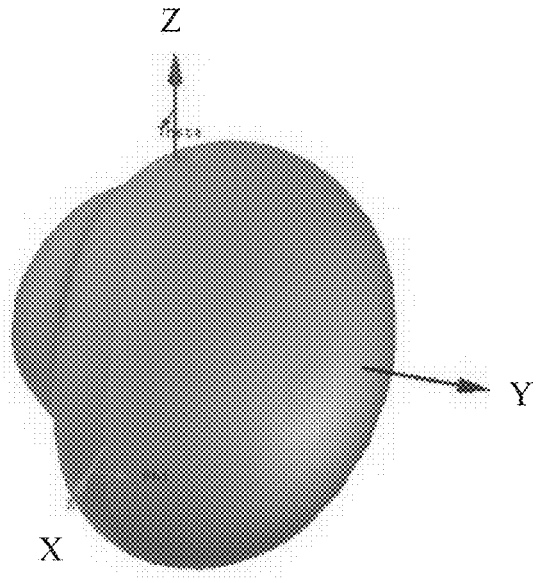
FIG. 4A is a radiation pattern of a first antenna when a mobile device does not include a first metal element and a second metal element.
Figure 4B:
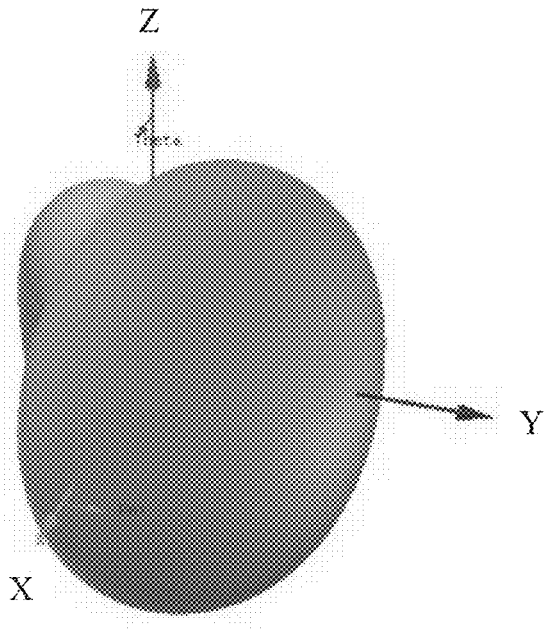
FIG. 4B is a radiation pattern of a first antenna when a mobile device includes a first metal element and a second metal element, according to an embodiment of the invention.

FIG. 4A is a radiation pattern of the first antenna 220 when the mobile device 200 does not include the first metal element 140 and the second metal element 150. FIG. 4B is a radiation pattern of the first antenna 220 when the mobile device 200 includes the first metal element 140 and the second metal element 150, according to an embodiment of the invention. The aforementioned radiation patterns are measured at the operation frequency of 751 MHz. Comparing the measurements of FIG. 4A and FIG. 4B, if the first metal element 140 and the second metal element 150 are incorporated into the mobile device 200, they can change the pattern distribution, the main beam direction, and the null positions of the first antenna 220, such that the radiation pattern of the first antenna 220 can become different from the original one.

Figure 5A:
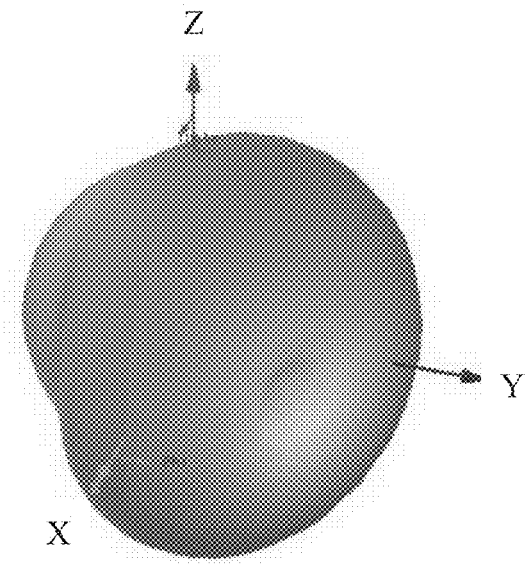
FIG. 5A is a radiation pattern of a second antenna when a mobile device does not include a first metal element and a second metal element.
Figure 5B:
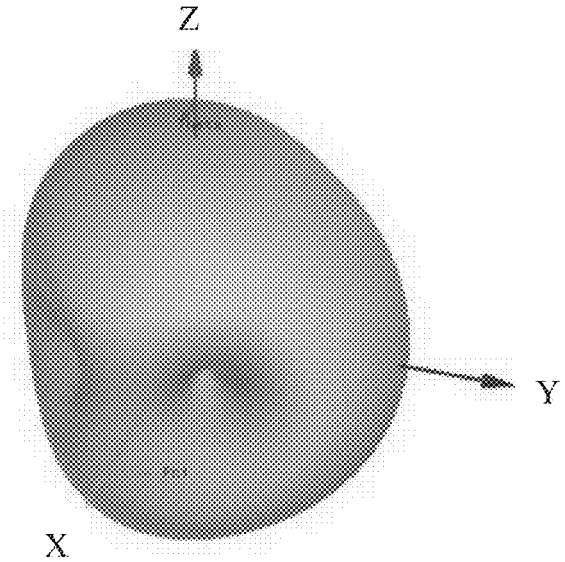
FIG. 5B is a radiation pattern of a second antenna when a mobile device includes a first metal element and a second metal element, according to an embodiment of the invention.

FIG. 5A is a radiation pattern of the second antenna 230 when the mobile device 200 does not include the first metal element 140 and the second metal element 150. FIG. 5B is a radiation pattern of the second antenna 230 when the mobile device 200 includes the first metal element 140 and the second metal element 150, according to an embodiment of the invention. The aforementioned radiation patterns are measured at the operation frequency of 751 MHz. Comparing the measurements of FIG. 5A and FIG. 5B, if the first metal element 140 and the second metal element 150 are incorporated into the mobile device 200, they can change the pattern distribution, the main beam direction, and the null positions of the second antenna 230, such that the radiation pattern of the second antenna 230 can become different from the original one.

As shown in FIG. 4B and FIG. 5B, after the first metal element 140 and the second metal element 150 are included, the radiation pattern of the first antenna 220 is apparently different from the radiation pattern of the second antenna 230, thereby increasing the diversity gain between the first antenna 220 and the second antenna 230. According to the practical measurement, the incorporation of the first metal element 140 and the second metal element 150 can significantly decrease an ECC (Envelope Correlation Coefficient) between the first antenna 220 and the second antenna 230, from original 0.9 to only 0.5. The above ECC can meet the requirement of practical application of MIMO antenna technology.

The invention proposes a novel MIMO antenna solution. In comparison to the conventional design, the invention has at least the advantages of: (1) effectively reducing the ECC between antennas, (2) having a simple structure and a low cost, and (3) being applicable to different antenna systems. Therefore, the invention is suitable for application in a variety of small-size mobile communication devices.

Note that the above element sizes, element shapes, and frequency ranges are not limitations of the invention. An antenna designer can adjust these settings or values according to different requirements. It should be understood that the mobile device and the antenna element of the invention are not limited to the configurations of FIGS. 1-5. The invention may merely include any one or more features of any one or more embodiments of FIGS. 1-5. In other words, not all of the features shown in the figures should be implemented in the mobile device and the antenna element of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

a ground plane;

a first antenna, having a first feeding point, wherein the first feeding point is coupled to a first signal source;

a second antenna, having a second feeding point, wherein the second feeding point is coupled to a second signal source;

a first metal element, having a connection end and an open end, wherein the connection end of the first metal element is coupled to the ground plane and is adjacent to the first feeding point; and a second metal element, having a connection end and an open end, wherein the connection end of the second metal element is coupled to the ground plane and is adjacent to the second feeding point;

wherein the first antenna and the second antenna are monopole antennas and are disposed on a dielectric substrate;

wherein the dielectric substrate has a first surface, a second surface, and a third surface, wherein the first surface and the third surface are parallel to each other, wherein the second surface is perpendicular to the first surface and the third surface, and wherein both the first antenna and the second antenna extend from the first surface through the second surface onto the third surface;

wherein the first antenna comprises:

a first radiation element, coupled to the first feeding point, and having a meandering structure so as to define a first notch, wherein the first radiation element extends from the first surface through the second surface onto the third surface, and further extends from the third surface through the second surface back onto the first surface.

2. The mobile device as claimed in claim 1, wherein the first metal element and the second metal element are configured to change radiation patterns of the first antenna and the second antenna, thereby reducing an ECC (Envelope Correlation Coefficient) between the first antenna and the second antenna.

3. The mobile device as claimed in claim 1, wherein the first antenna and the second antenna cover a same operation frequency which is about 751 MHz.

4. The mobile device as claimed in claim 3, wherein the first metal element substantially has an L-shape, and a length of the first metal element is approximately equal to 0.25 wavelength of the operation frequency.

5. The mobile device as claimed in claim 3, wherein the second metal element substantially has an L-shape, and a length of the second metal element is approximately equal to 0.25 wavelength of the operation frequency.

6. The mobile device as claimed in claim 1, wherein the ground plane has a first edge and a second edge which are perpendicular to each other, wherein the connection end of the first metal element is coupled to the first edge, wherein the connection end of the second metal element is coupled to the second edge, and wherein the first antenna and the second antenna are both adjacent to a corner between the first edge and the second edge.

7. The mobile device as claimed in claim 1, wherein the first antenna further comprises:

a second radiation element, coupled to the first radiation element, and disposed in the first notch, wherein the second radiation element extends from the first surface onto the second surface; and a third radiation element, coupled to the first radiation element, wherein the third radiation element extends from the first surface through the second surface onto the third surface.

8. The mobile device as claimed in claim 1, wherein the second antenna comprises:

a fourth radiation element, coupled to the second feeding point, and having a meandering structure so as to define a second notch, wherein the fourth radiation element extends from the first surface through the second surface onto the third surface, and further extends from the third surface through the second surface back onto the first surface; and a fifth radiation element, coupled to the fourth radiation element, and disposed in the second notch, wherein the fifth radiation element extends from the first surface onto the second surface.

* * * * *